US005806664A

United States Patent [19]

Hartman et al.

[11] Patent Number: 5,806,664

[45] Date of Patent: Sep. 15, 1998

[54] ADAPTIVE SHAPED VEHICLE CONTROL DEVICE

[75] Inventors: Hollister Hartman, Northville, Mich.; Robin Mihekan Miller, Ellington, Conn.

[73] Assignee: UT Automotive Dearborn, Inc., Dearborn, Mich.

[21] Appl. No.: 824,372

[22] Filed: Mar. 25, 1997

[51] Int. Cl.[6] ..... H01H 3/00

[52] U.S. Cl. ..... 200/329; 200/61.28

[58] Field of Search ..... 200/329, 330, 200/335, 61.27, 61.28

[56] References Cited

U.S. PATENT DOCUMENTS 5,155,878 10/1992 Dellis ..... 16/111 R 5,571,059 11/1996 Desautels et al. ..... 477/111

5,669,094 9/1997 Swanson ..... 5/740

*Primary Examiner*—David J. Walczak

*Attorney, Agent, or Firm*—Howard & Howard

[57] ABSTRACT

Switches incorporate a material layer which becomes fluent upon reaching a predetermined temperature such that the switch body moves to correspond to the individual position and shape of a user's hand. The material layer is made to become fluent, and the layer then flows to correspond to the individual user's hand orientation and shape. In one embodiment, the layer of material is a foam which is fluent at human body temperature. The foam thus automatically corresponds to the shape of the user's hand when the user grips the switch body. In the second embodiment, the layer of material is actuated at a relatively higher temperature and a heating coil is provided to move the layer to that higher temperature.

14 Claims, 1 Drawing Sheet

ADAPTIVE SHAPED VEHICLE CONTROL DEVICE

BACKGROUND OF THE INVENTION

This invention relates to a control device such as a switch, with a body which conforms to the particular shape of a user's hand. The switch body includes material which is actuated by heat to become fluent and flow to correspond to the individual user's hand.

Modern vehicle controls are becoming more and more complex. A driver is provided with many control switches which must be manipulated during driving. The switches are manufactured in mass, and are generally designed to be a "best fit" approximation for the hand of an average user. Of course there is no true "average" user. Thus, the known switch bodies actually correspond to the individual characteristics of only a very few users. There are a wide variety of sizes and shapes of user's hands. The standard switch bodies may be too large for an individual with a small hand, or too small for an individual with a relatively large hand. This provides discomfort and in some cases pain to the individual drivers.

Moreover, some users may position their hands at a different angle or orientation on the switch body when compared to the position predicted by the switch designer. This also presents discomfort in utilizing the switch for some individual drivers.

While reconfigurable switches have been proposed, in general these relate to repositioning the elements of the switch, and require the user to actively realign components. Such realignment of a switch may distract a driver's attention from the road, which is undesirable. Moreover, any such realignment of a switch typically still would not result in a switch body which corresponds identically to the characteristics of an individual user's hand.

SUMMARY OF THE INVENTION

In a disclosed embodiment of this invention, a switch body for use in a vehicle is provided with a layer of material that is actuated by heat to became fluent and flow to correspond to the characteristics of an individual user's hand.

When a driver places a hand on the switch body, in any size, or in an orientation that is different from that predicted by the switch designer, the material flows to correspond to the shape and orientation of the driver's hand. In this way, the switch body is tailored automatically for the individual driver's hand characteristic and placement. Whether the driver has small hands or large hands will not matter, as the switch body tailors itself to the individual characteristics.

In one disclosed embodiment, the layer of fluent material is positioned adjacent an outer surface of the switch body. The material is preferably a polymer, and preferably a foam which becomes fluent at body temperature range and caused to flow. Thus, when a driver grips the switch body, the material becomes fluent and flows to fill any spaces between the driver's hand and the original switch body shape, and moves away from any pressure points where the drivers particular hand size and orientation may be forced against the outer surface. When the driver removes the hand, the material stays in the new position such that the next time the driver utilizes the switch, the switch body already corresponds to the desired orientation and shape.

In a second embodiment, the material becomes fluent at a relatively high temperature. With this embodiment a heating element, such as a coil is embedded within the material. The driver is preferably provided with a second switch which actuates the heating coil to cause the material to become fluent and flow. The flow of the material occurs generally as described above, once actuated by the heating element. Once the switch body shape has been modified to correspond to the driver, the coil shuts off. A timer may limit the amount of time the coil is actuated to the expected time necessary to allow the material to flow and correspond to the driver's hand characteristics. Once the switch material has flowed to correspond to the shape of the driver's hand, the coil is turned off and the material cools. The switch body remains in the desired shape such that the same driver need not reconfigure the switch body again when reusing the switch.

With the second embodiment material that is heated as by a coil, it is preferred that a pad and insulation layer are placed between the material and the driver's hand. The layers are preferably relatively thin and flexible such that the layers corresponds to the shape of the user's hand and to the shape of the fluent material which is flowing to correspond to the user's hand.

These and other features of the present invention will be best understood from the following specification and drawings, of which the following is a brief description.

DETAILED DESCRIPTION OF THE PREFERRED EMBODIMENT

Figure 1A:
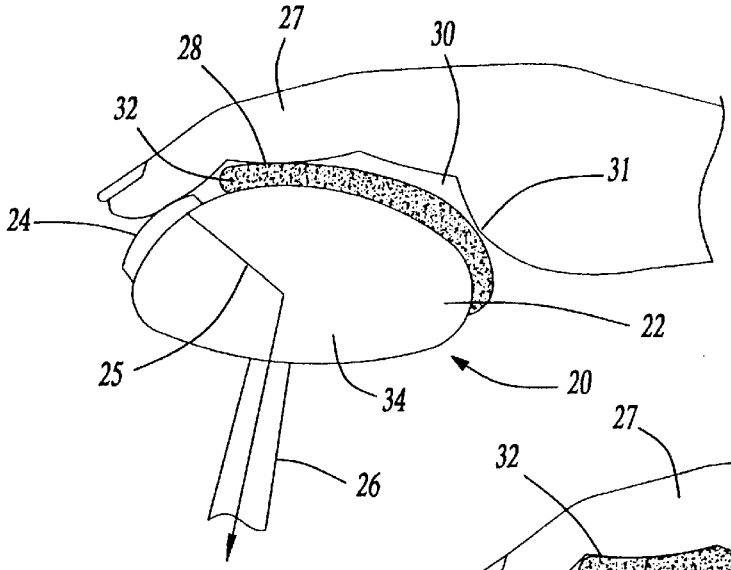
FIG. 1A shows a first embodiment of the present invention when a driver first places a hand on the inventive switch.

FIG. 1A shows a switch system 20 including a switch body 22 as may be utilized for a gear shift or stick shift knob. Other types of switch systems may also utilize the present invention. This invention is not limited to any one particular type of switch. As shown, a switch 24 is provided near a forward end of body 22, and communicates to a control through a wire 25, shown schematically, through a stalk 26. Stalk 26 is typically mounted in the vehicle body and is relatively small compared to the larger body portion 22. It must be understood, the stalk embodiment is shown as an example. The invention extends to switches of other configurations with or without a stalk.

As shown, a driver's hand 27 is placed on the body 22. The driver's hand is shown positioned such that the finger tips are generally aligned with switch 24. The driver illustrated might have the individual preference of positioning fingertips adjacent the switch 24 to easily actuate the switch. To position the driver's hand 27 in this orientation, a pressure point 28 may be created wherein a rear portion of the driver's fingers are being forced against the switch body 22. In addition, a hollow 30 may be formed between the driver's hand and the switch body 22 in this orientation. A final pressure point 31 is shown formed beneath hollow 30. The hollow 30 could provided discomfort to the driver as could the pressure points 28 and 31. These pressure points and hollows are examples, any many other hand shapes and orientations will be experienced by any switch in mass production on a vehicle.

FIG. 1A shows an inventive fluent material layer 32 placed between the driver's hand 27 and a core portion 34 of switch body 22. Core 34 may be formed of a rigid plastic which will not change its shape.

The material layer 32 is preferably formed of a material such as a temperature sensitive foam, which becomes fluent when heated to temperatures on the order of human body temperature. One such foam is available from Dan-Foam A/S of Denmark, which is a subsidiary of Fagerdala World Foams ab. The foam available from this company is available under the trade name Tempur-Pedic®. Other materials including other foams and non-foams, are known, and are operable to become fluent upon reaching a temperature approximately at body temperature. These other materials may also be used in the inventive type switches. When the driver's hand 27 rests on the switch body 22 for a period of time, the fluent layer 32 reaches body temperature. At that time, the fluent material becomes fluent and flows away from the pressure points 28, 31 and into hollows 30.

Figure 1B:
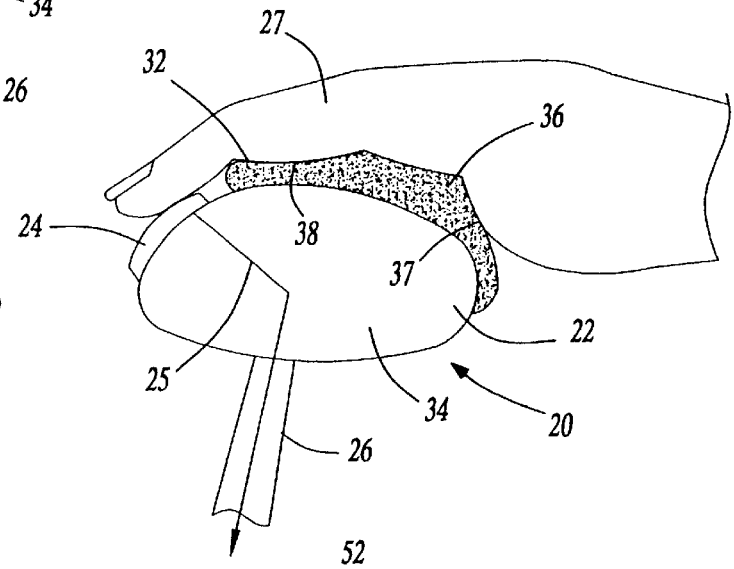
FIG. 1B shows a period of time somewhat subsequent to that shown FIG. 1A, with the first embodiment switch having moved to correspond to the driver's hand.

As shown in FIG. 1B the driver's hand 27 has now remained placed on the switch body 22 for a period of time. In the area of prior pressure point 28, the fluent material 32 has moved away to form a hollow 38. The pressure point no longer causes discomfort to the operator. A portion 36 of the material has now moved to fill the hollow 30. Finally, another hollow 37 has been formed by the pressure point 31 on the opposed side of the hollow 30. The size of hollows 37 and 38, and portion 36 may typically not be as pronounced as shown. Applicant has illustrated them relatively large to show the existence of the reconfigured structures.

The material layer 32 now corresponds to the driver's hand orientation and characteristics. Whether the driver has small or large hands or utilizes an unusual hand orientation on the switch will not matter. The switch body individually tailors itself to the individual driver.

When the driver removes the hand from the switch, the fluent material 32 cools. The material 32 may be somewhat resilient, but should maintain at least the general reconfigured contour. Thus, when the driver again uses this switch, the fluent material 32 need not be fully reconfigured again to correspond to the individual driver. The switch is already approximately in the desired shape. The material will become fluent again, but since the same driver is using the switch, little reconfiguration should occur. If a different driver uses the vehicle, the switch will reconfigure itself to correspond to the new driver.

Figure 2:
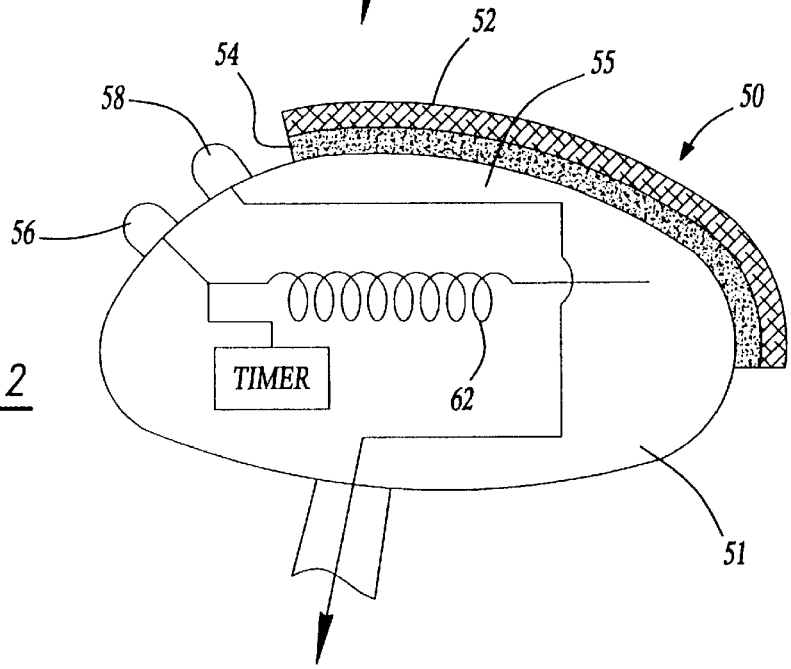
FIG. 2 shows a second embodiment switch.

FIG. 2 shows another switch system 50 having a switch body 51 including an outer comfort pad 52. An insulator layer 54 is placed between the comfort pad 52 and an inner fluent material layer 55 of the switch body. Layer 52 and 54 may be relatively thin pads which are flexible and can correspond to the shape of the fluent material layer 55. Layer 55 is preferably formed of a material that requires a higher temperature to become actuated then the first embodiment, described above. Acceptable materials include hot-melt adhesives as are used for glue-guns, and which are heated to become fluent and then harden. As known in the art of hot-melt adhesives, by controlling the composition, different melting temperatures can be achieved. Other materials with the ability to become fluent with heat may also be used.

The second embodiment includes switches 56 and 58. Switch 58 is the main switch provided by switch system 50, and communicates with a control for a vehicle component. Switch 56 is provided on the switch body 51 and may be less accessible than switch 58. Switch 56 preferably controls a heating coil 62 within material layer 55. When a driver wishes to modify the shape of switch body 51, the driver actuates switch 56. Coil 62 heats, and material layer 55 is actuated to become fluent. Material layer 55 then flows to correspond to the shape of the individual driver's hand as in the prior embodiment. The comfort pad 52 and insulation layer 54 ensure there is no discomfort to the driver due to the heated material 55. The actuation of the coil control occur automatically, as an example with actuation of switch 58. Moreover, other heating elements beside coil 62 may be used.

Preferably a timer is included and communicates with the coil 62. The timer shuts down coil 62 after a period of time which is selected to estimate the amount of time necessary for the material layer 55 to flow to the shape of the individual driver's hand. Once the coil 62 is shut off and the material layer 55 cools, the material layer 55 retains the modified shape which corresponds to the driver's hand. Thus, the driver need not reactuate and reconfigure or conform the switch body with each subsequent use. If a new driver uses the switch body 50, then the switch 56 will again be actuated to cause the switch body 51 to be modified to correspond to the new driver's hand orientation and shape.

The invention is disclosed above somewhat schematically. It may be desirable in certain applications to provide additional covering layers in the first embodiment, such as the comfort pad. Moreover it may be desirable to include a relatively rigid plastic shell around portions of the actuatable material layer 55 of the second embodiment. The relatively hard shell may encase all portions of the switch body, other than the upper portions where the user's hand may grip the material layer. The particular shape and final configuration of the switch may take several configurations.

While the above embodiments include electrical switches, it should be understood the invention extends to optical fiber, RF and any other type switches capable of sending a signal.

A preferred embodiment of this invention has been disclosed, however, a worker of ordinary skill in the art would recognize that certain modifications would come within the scope of this invention. For that reason, the following claims should be studied to determine the true scope and content of this invention.

We claim:

1. a switch comprising;

a first switch for sending a signal;

a switch body receiving said first switch, and being provided with a material layer which may be actuated to become fluent and move to a desired orientation upon reaching a predetermined temperature, such that said layer of material will flow to correspond to the orientation and shape of a driver's hand when the driver holds said switch body; and said first switch being an electrical switch.

2. A switch system as recited in claim 1, wherein said switch body has an enlarged body portion carrying said first switch and said material layer, and a stalk portion extends from said enlarged body portion and is adapted to be connected to a vehicle.

3. A switch system as recited in claim 1, wherein said material layer is actuated in the range of human body temperature to become fluent such that it can move to correspond to the individual user's hand.

4. A switch system as set forth in claim 3, wherein said material layer is positioned at an outer layer of said switch body.

5. A switch system as recited in claim 3, wherein said material layer is a foam which is actuatable to become fluent at the approximate range of human body temperature.

6. A switch comprising a first switch for sending a signal;

a switch body receiving said first switch, and being provided with a material layer which may be actuated to become fluent and move to a desired orientation upon reaching a predetermined temperature, such that said layer of material will flow to correspond to the orientation and shape of a driver's hand when the driver holds said switch body; and said layer of material is actuated to become fluent at a temperature greater than human body temperature and a heating element is provided within said material layer to raise said material layer to a temperature wherein it is actuated to become fluent.

7. A switch system as recited in claim 6, wherein heating element includes an electrical coil.

8. A switch system as recited in claim 7, wherein said switch body is provided with a second switch which selectively actuates said heating element.

9. A switch system as recited in claim 8, wherein a timer is provided to shut said coil off after a predetermined period of time.

10. A switch system as recited in claim 6, wherein an insulation material is placed between said material layer and an outer surface of said switch body.

11. A method of forming a switch to correspond to a user's hand comprising with steps of:

1) providing a switch body having a first switch for sending a signal at one location and a material layer which may be actuated to become fluent such that it can flow to correspond to the shape of a user's hand;

2) placing a users hand on the switch; and 3) causing said material layer to become fluent and flow to correspond to the orientation and shape of the user's hand, said material layer being actuated at a temperature higher than human body temperature, and the method including the steps of providing a heating element within said material layer, and actuating said heating element to actuate said material layer to flow in step 3) to correspond to the user's hand.

12. A method as recited in claim 11, wherein said material layer is actuated to become fluent at human body temperature, and becomes fluent due to the user's hand in step 2).

13. A method as set forth in claim 11, wherein said switch body is provided with a second switch to actuate said heating element, and said heating element being provided with a timer, said timer turning off said heating element after a predetermined period of time.

14. A switch system to be incorporated into a vehicle comprising:

a switch body having an enlarged portion to be held by a user's hand and a relatively small stalk portion to be attached to a vehicle, said switch body being provided with an electrical switch adjacent one end;

a layer of material which is actuated upon reaching a predetermined temperature to become fluent, said layer of material being operable when actuated to flow and correspond to the individual orientation and shape of a user's hand, said material layer being actuated in the range of human body temperature to become fluent such that it can now move to correspond to the user's hand, and said layer of material being positioned relative to said electrical switch such that the portion of said material which reconfigures to the user's hand can be held while the user operates said electrical switch.

* * * * *